US011101602B2

(12) United States Patent
Maesoba et al.

(10) Patent No.: US 11,101,602 B2
(45) Date of Patent: Aug. 24, 2021

(54) CONNECTOR SYSTEM FOR ACCOMMODATING EITHER UTP OR STP CONNECTION TERMINALS

(71) Applicants: AutoNetworks Technologies, Ltd., Mie (JP); Sumitomo Wiring Systems, Ltd., Mie (JP); SUMITOMO ELECTRIC INDUSTRIES, LTD., Osaka (JP)

(72) Inventors: Hiroyoshi Maesoba, Mie (JP); Toshifumi Ichio, Mie (JP)

(73) Assignees: AutoNetworks Technologies, Ltd., Mie (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 16/340,541

(22) PCT Filed: Sep. 21, 2017

(86) PCT No.: PCT/JP2017/034004
§ 371 (c)(1),
(2) Date: Apr. 9, 2019

(87) PCT Pub. No.: WO2018/070202
PCT Pub. Date: Apr. 19, 2018

(65) Prior Publication Data

US 2019/0288456 A1 Sep. 19, 2019

(30) Foreign Application Priority Data

Oct. 12, 2016 (JP) ..... JP2016-200512

(51) Int. Cl.
*H01R 13/40* (2006.01)
*H01R 13/6463* (2011.01)
(Continued)

(52) U.S. Cl.
CPC ..... *H01R 13/6463* (2013.01); *H01R 13/187* (2013.01); *H01R 13/424* (2013.01); *H01R 13/6474* (2013.01)

(58) Field of Classification Search
CPC ..... H01R 13/4223; H01R 13/4362
(Continued)

(56) References Cited

U.S. PATENT DOCUMENTS 5,004,436 A * 4/1991 Aoyama ..... H01R 13/4368 439/752
5,100,345 A * 3/1992 Endo ..... H01R 13/506 439/592
(Continued)

FOREIGN PATENT DOCUMENTS

JP 2009-135122 6/2009
JP 5087487 12/2012
(Continued)

OTHER PUBLICATIONS

International Search Report.

*Primary Examiner* — Thanh Tam T Le
(74) *Attorney, Agent, or Firm* — Gerald E. Hespos; Michael J. Porco; Matthew T. Hespos

(57) ABSTRACT

A connector structure enables the replacement of an STP cable (10B) and a UTP cable (10A) without making a large structural change. UTP connection terminals (21A) to be connected to respective wires (11) of the UTP cable (10A) are arranged to be proximate in a width direction by being accommodated into accommodating portions (26) of a UTP dielectric (22A) proximate in the width direction. STP connection terminals (21B) to be connected to respective wires (11) of the STP cable (10B) are farther apart in the width direction than the UTP connection terminals (21A) by being accommodated in accommodating portions (26) of an STP dielectric (22B) spaced apart in the width direction. The
(Continued)

UTP connection terminals and the STP connection terminals are set such that protrusions (34) projecting out from box portions (27) in a common direction when accommodated in the accommodating portions (26).

2 Claims, 22 Drawing Sheets

(51) Int. Cl.
*H01R 13/187* (2006.01)
*H01R 13/424* (2006.01)
*H01R 13/6474* (2011.01)

(58) Field of Classification Search
USPC ..... 439/595, 752
See application file for complete search history.

(56) References Cited

U.S. PATENT DOCUMENTS 5,186,662 A * 2/1993 Yuasa ..... H01R 13/4368 439/595
5,299,958 A * 4/1994 Ohsumi ..... H01R 13/4362 439/752
5,455,515 A * 10/1995 Saijo ..... H01R 13/641 324/538
5,622,521 A * 4/1997 Marceau ..... H01R 13/4368 439/595
5,643,018 A * 7/1997 Sakai ..... H01R 13/113 439/595
5,733,144 A * 3/1998 Tsuji ..... H01R 13/4223 439/595
6,086,419 A * 7/2000 Marpoe, Jr. ..... H01R 13/4226 439/595
6,244,910 B1 * 6/2001 Grubbs ..... H01R 13/113 439/595
6,280,209 B1 8/2001 Bassler et al.
6,290,539 B1 * 9/2001 Wilber ..... H01R 13/4223 439/595
6,375,501 B1 * 4/2002 Kojima ..... H01R 13/4223 439/382
6,752,660 B2 * 6/2004 Fujita ..... H01R 13/113 439/595
7,229,328 B2 * 6/2007 Sawada ..... H01R 43/16 439/595
7,281,961 B1 * 10/2007 Sugiyama ..... H01R 13/113 439/595
8,113,881 B2 * 2/2012 Sakamoto ..... H01R 13/4223 439/595
8,333,622 B2 * 12/2012 Blasko ..... H01R 13/113 439/852
9,004,940 B2 * 4/2015 Hasebe ..... H01R 13/4223 439/595
9,028,277 B2 * 5/2015 Nemoto ..... H01R 13/422 439/595
2011/0136391 A1 6/2011 Kameyama
2015/0200486 A1 7/2015 Yagi et al.
2017/0352989 A1 12/2017 Takahashi

FOREIGN PATENT DOCUMENTS

JP 5333632 11/2013
JP 2015-53194 3/2015
JP 2015-149189 8/2015
JP 2016-39046 3/2016
JP 2016-115625 6/2018
WO 2016/132855 8/2016

* cited by examiner

CONNECTOR SYSTEM FOR ACCOMMODATING EITHER UTP OR STP CONNECTION TERMINALS

BACKGROUND

Field of the Invention

The invention relates to a connector structure.

Related Art

A twisted pair cable is a cable formed by twisting a plurality of wires and often is used in an in-vehicle network and the like since is affected less by noise and has less noise radiation than mere parallel wires. Twisted pair cables include STP (Shield Twisted Pair) cables and UTP (Unshield Twisted Pair) cables. STP cables have wires surrounded by a shield conductor, and have a strong resistance to noise.

Japanese Patent No. 5333632 discloses a connector with inner conductor terminals to be connected to an end part of an STP cable, an inner housing (dielectric) for accommodating the inner conductor terminals, a shield shell connected to a shield conductor of the STP cable and surrounding the inner housing and an outer housing for accommodating the shield shell.

Japanese Patent No. 5087487 discloses a connector with connection terminals to be connected to an end part of a UTP cable and a connector body (dielectric) including a terminal accommodating portion for accommodating the connection terminals.

The connectors of Japanese Patent No. 5333632 and Japanese Patent No. 5087487 have a common configuration where wires of the UTP cable and STP cable are connected to the terminals and each terminal is accommodated in the dielectric. An ability to replace the STP cable by the UTP cable or replace the UTP cable by the STP cable utilizing common structural parts in the respective connectors, would facilitate mold design and reduce cost. However, there is no compatibility between the UTP cable and the STP cable and impedances of the UTP cable and the STP cable are different. Thus, sufficient attention has to be paid to this point.

The present invention was completed on the basis of the above situation and aims to provide a connector structure enabling the replacement of an STP cable and a UTP cable without making a large structural change.

SUMMARY

The invention is directed to a connector structure with UTP connection terminals and STP connection terminals. Each UTP connection terminal includes a box portion into which a male terminal can be inserted and connected. A protrusion projects out of the box portion. The UTP connection terminals are connected to respective wires of a UTP cable. Each STP connection terminals includes a box portion into which a male terminal can be inserted and connected. A protrusion projects out of the box portion. The STP connection terminals are connected to respective wires of a STP cable. A UTP dielectric includes accommodating portions for accommodating the UTP connection terminals, and an STP dielectric includes accommodating portions for accommodating the STP connection terminals. A pair of the accommodating portions of the UTP dielectric and a pair of the accommodating portions of the STP dielectric are arranged in a width direction perpendicular to an inserting direction of the male terminals. The UTP connection terminals are arranged close to each other in the width direction by being accommodated into the pair of accommodating portions of the UTP dielectric that are proximate in the width direction. The STP connection terminals are arranged farther away from each other in the width direction than in the case of the UTP connection terminals by being accommodated into the pair of accommodating portions of the STP dielectric that are spaced farther apart in the width direction. The UTP connection terminals and the STP connection terminals are set such that the protrusions all are in the same orientation when accommodated in the accommodating portions.

The UTP connection terminals connected to the respective wires of the UTP cable are arranged close to each other in the width direction by being accommodated in the pair of accommodating portions that are proximate in the width direction. Thus, impedance can be reduced. On the other hand, the STP connection terminals connected to the respective wires of the STP cable are arranged apart from each other in the width direction by being accommodated in the pair of accommodating portions that are spaced apart in the width direction. Thus, impedance can be increased. In this way, the impedance can be adjusted appropriately between the UTP cable and the STP cable. In adjusting the impedance, the UTP connection terminals may be accommodated into the accommodating portions that are proximate in the width direction, while the STP connection terminals may be accommodated into the accommodating portions spaced apart in the width direction without making a large structure change. Thus, the UTP cable and the STP cable can be replaced easily.

In some embodiments, the UTP connection terminals and the STP connection terminals are accommodated into the corresponding accommodating portions with the protrusions in the same orientation. Thus, the respective connection terminals can be mounted in the same direction into the accommodating portions and work efficiency at the time of mounting the terminals is good.

A receiving portion and a resilient contact piece facing the receiving portion may be arranged in the box portion. The resilient contact piece may project more into the box portion than the receiving portion and the male terminal may be sandwiched between the receiving portion and the resilient contact piece. The UTP connection terminals may be accommodated in the pair of accommodating portions of the UTP dielectric such that the resilient contact pieces are located on inner sides proximate in the width direction and the receiving portions are located on outer sides spaced apart in the width direction. Conversely, the STP connection terminals may be accommodated in the pair of accommodating portions of the STP dielectric such that the resilient contact pieces are located on outer sides spaced apart in the width direction and the receiving portions are located on inner side proximate in the width direction. According to this configuration, a separation distance in the width direction (pitch width) of male terminals to be inserted in and connected to the box portions can be the same between the UTP cable side and the STP cable side. As a result, mating connectors also need not be changed structurally a large amount.

DETAILED DESCRIPTION

Figure 1:
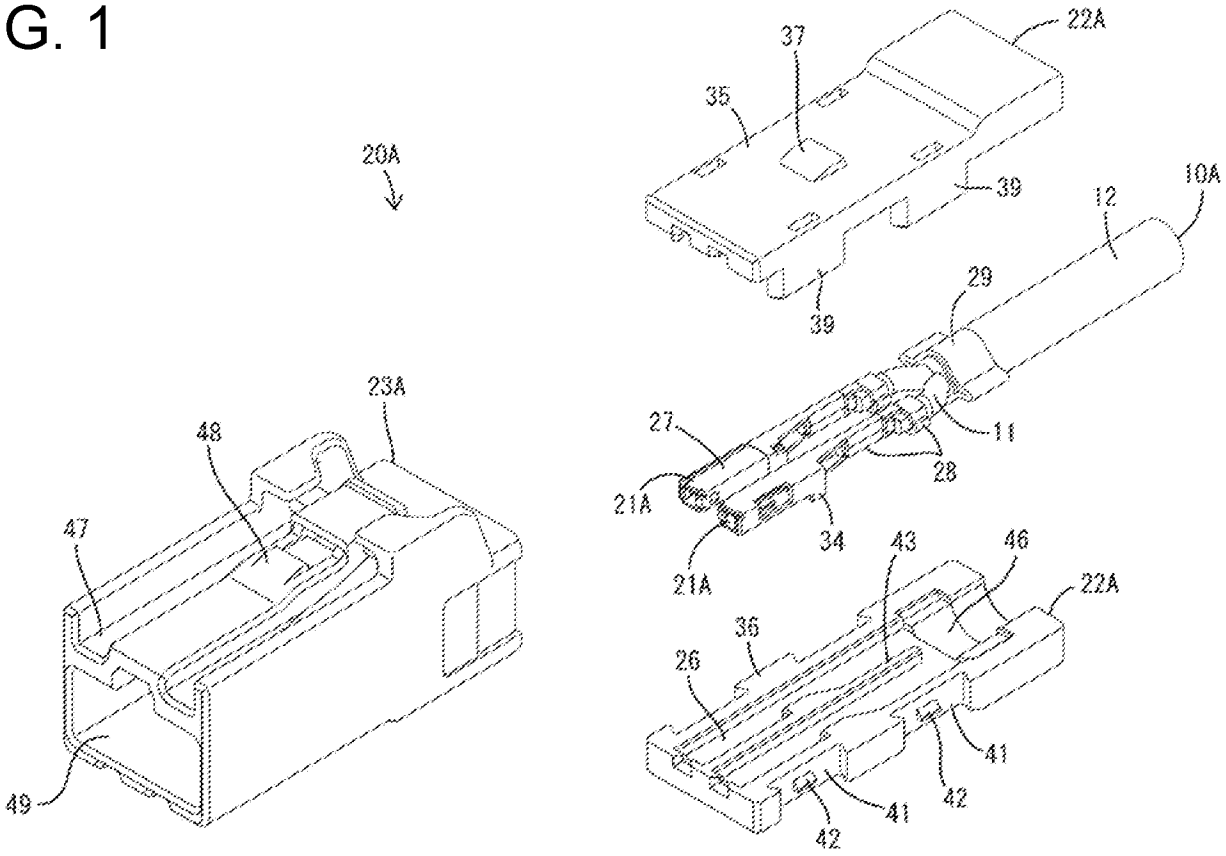
FIG. 1 is an exploded perspective view of a UTP connector in a connector structure of one embodiment of the present invention.
Figure 5:
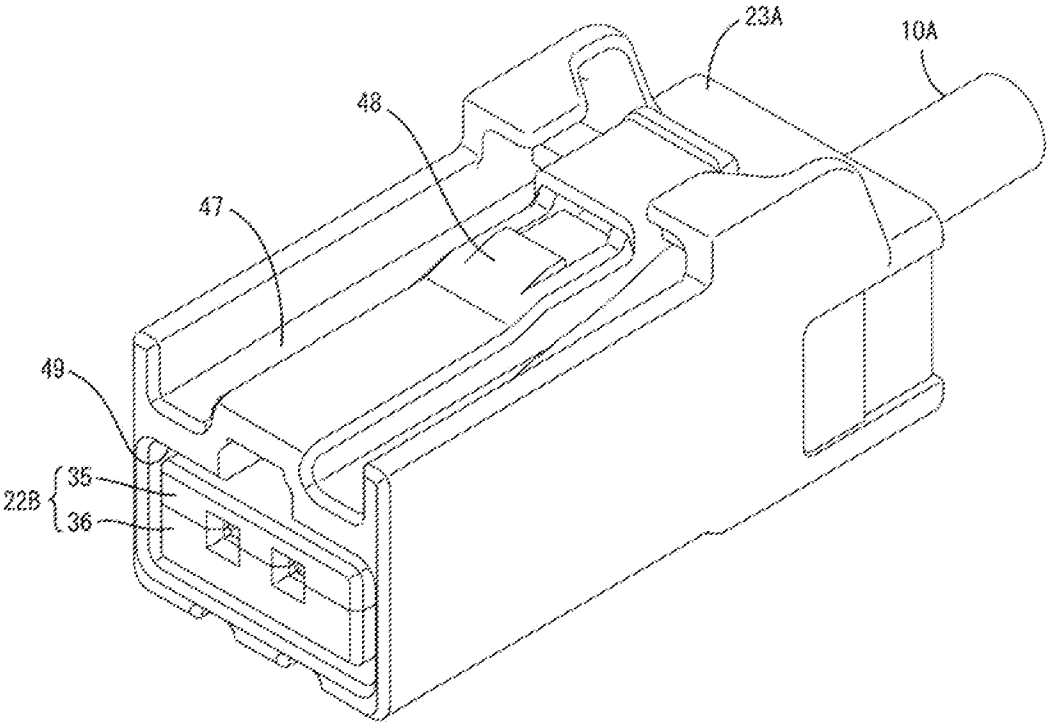
FIG. 5 is a perspective view showing a state where the UTP dielectric is accommodated in a UTP housing.
Figure 10:
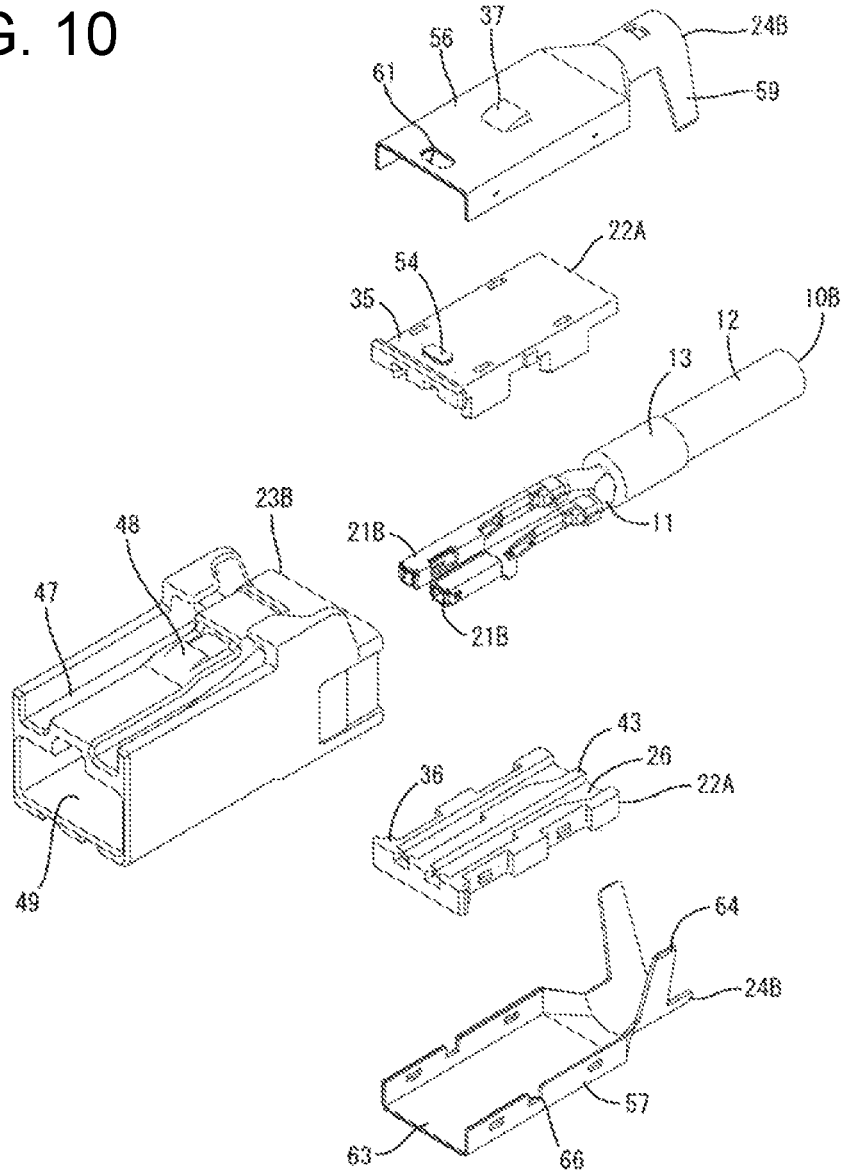
FIG. 10 is an exploded perspective view of an STP connector.
Figure 19:
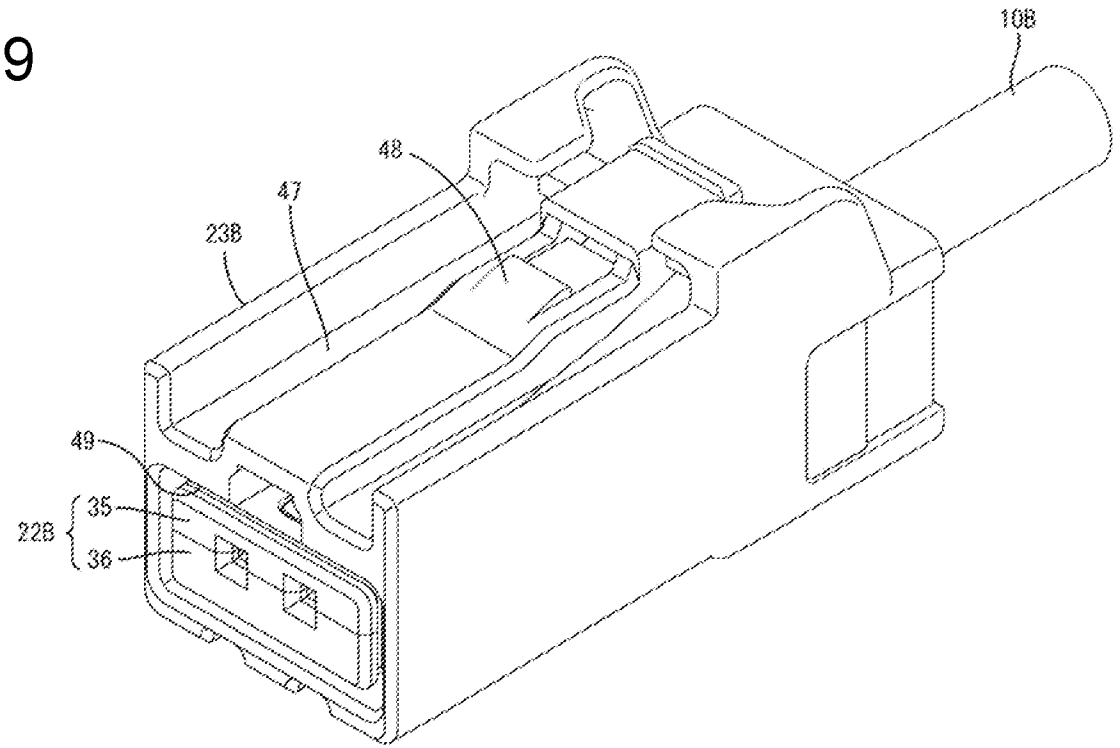
FIG. 19 is a perspective view showing a state where the STP dielectric is accommodated in an STP housing.

One embodiment of the invention is described on the basis of the drawings. A connector structure of this embodiment is used in an in-vehicle communication network system and composed of a UTP connector 20A provided on an end part of a UTP cable 10A as shown in FIGS. 1 and 5 and an STP connector 20B provided on an end part of an STP cable 10B as shown in FIGS. 10 and 19. The UTP connector 20A and the STP connector 20B have structural parts common or approximate to each other, and the UTP cable 10A and the STP cable 10B can be replaced by each other easily while impedance is adjusted.

Figure 8:
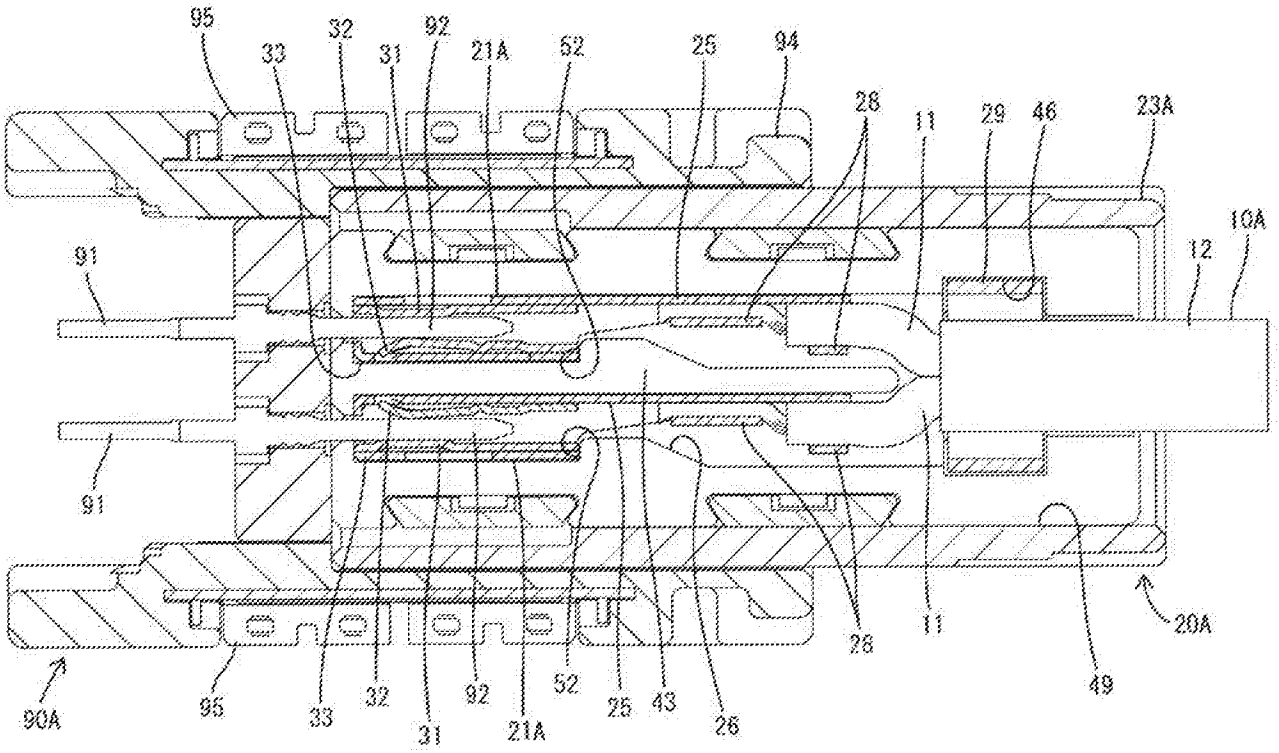
FIG. 8 is a section showing a state where the UTP connector and the mating UTP connector are connected to each other.
Figure 23:
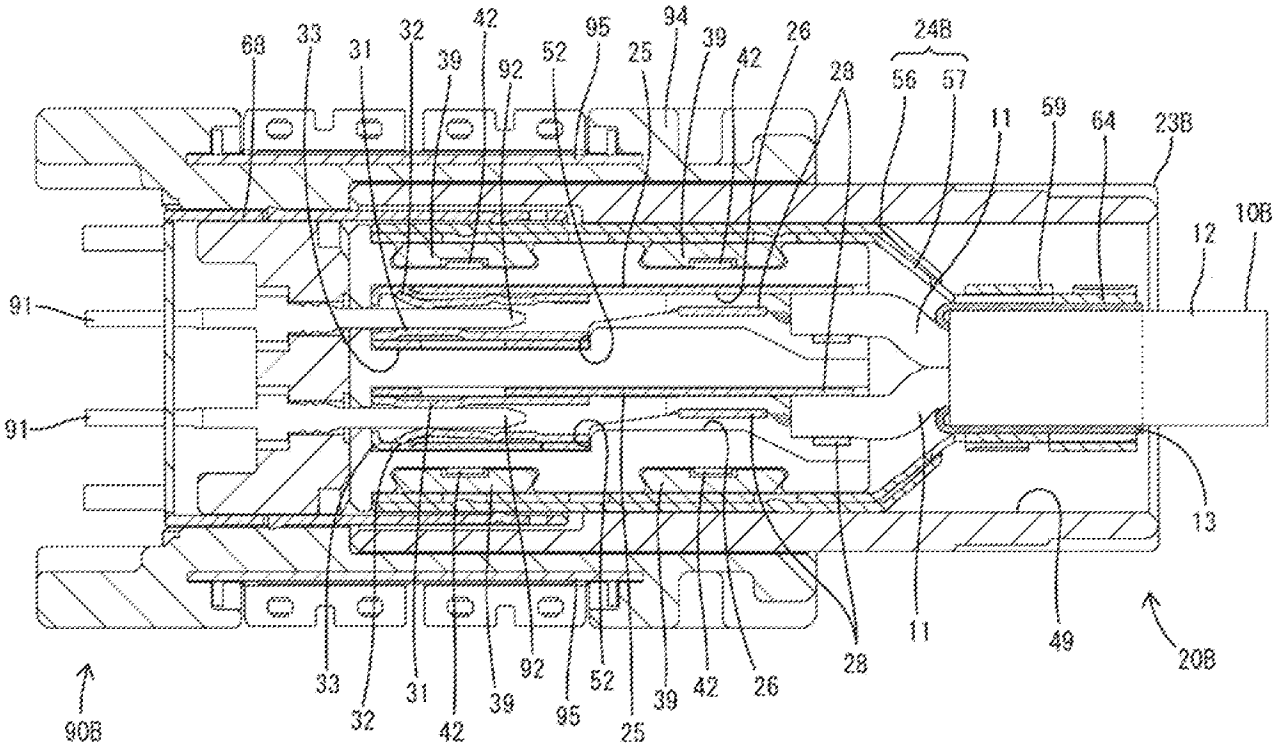
FIG. 23 is a section showing a state where the STP connector and the mating STP connector are connected to each other.

As shown in FIG. 8, the UTP connector 20A is connected to a mating UTP connector 90A and includes UTP connection terminals 21A, a UTP dielectric 22A and a UTP housing 23A. As shown in FIG. 23, the STP connector 20B is connected to a mating STP connector 90B and includes STP connection terminals 21B, an STP dielectric 22B, an outer conductor 24B and an STP housing 23B. Note that words "UTP" and "STP" in the terms of the above respective members are merely added for convenience to distinguish these.

UTP Cable

The UTP cable 10A is composed of a pair of twisted wires 11 and a sheath 12 surrounding the respective wires 11. The wire 11 is composed of a conductor and a coating surrounding the conductor. An end of each wire 11 is exposed from the sheath 12 and connected to the UTP connection terminal 21A.

UTP Connection Terminal

Figure 2:
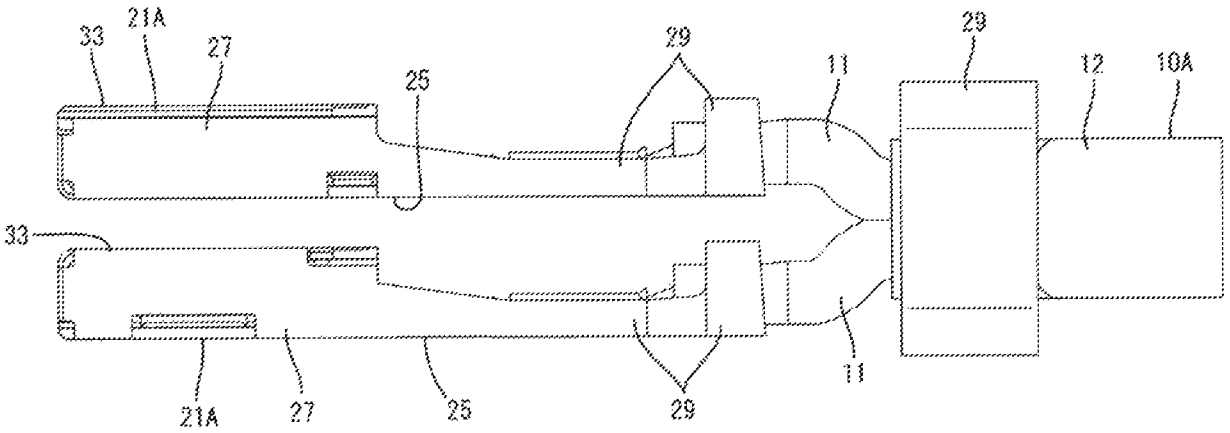
FIG. 2 is a plan view of UTP connection terminals connected to wires of a UTP cable.

The UTP connection terminals 21A to be connected to the respective wires 11 of the UTP cable 10A have substantially the same form except a different arrangement of some parts (resilient contact pieces 32 and receiving portions 31 to be described later). As shown in FIG. 8, the UTP connection terminal 21A is connected to a male terminal 91 provided in the mating UTP connector 90A when the UTP connector 20A and the mating UTP connector 90A are connected. As shown in FIG. 2, the UTP connection terminal 21A is formed integrally such as by bending a conductive metal plate material and shaped to be long and narrow in a front-rear direction (lateral direction of FIG. 2).

Specifically, the UTP connection terminal 21A includes a base plate 25 in the form of a strip extending along the front-rear direction. A box 27 substantially in the form of a rectangular tube is provided on a front end part of the base plate 25, and an open barrel 28 is provided on a rear end part of the base plate 25. The barrel 28 is connected electrically and mechanically to the conductor and the coating of the wire 11. Note that a crimp ring 29 separate from the UTP connection terminals 21A is crimped and connected to an end part of the sheath 12 of the UTP cable 10A. The crimp ring 29 includes parts protruding while being held in close contact on both widthwise sides by crimping.

The receiving portion 31 and the resilient contact piece 32 project to face each other in a width direction (direction perpendicular to an inserting direction of the male terminal 91 into the box 27, vertical direction of FIG. 8) inside the box 27.

The UTP connection terminal 21A is to be accommodated into one accommodating portion 26 that is to be described later. This UTP connection terminal 21A includes a receiving portion 31 that has a trapezoidal cross-sectional shape and that is fixed on the base plate 25 and also has a strip-like resilient contact piece 32 provided on a ceiling plate 33 opposite to the base plate 25. In contrast, the UTP connection terminal 21A is to be accommodated into the other accommodating portion 26 that is to be described later and has the resilient contact piece 32 provided on the base plate 25 and the receiving portion 31 provided on the ceiling plate portion 33. The resilient contact piece 32 is cantilevered forward from a rear end of the ceiling plate 33 and is deflectable and deformable with the rear end of the ceiling plate 33 as a support.

Figure 9:
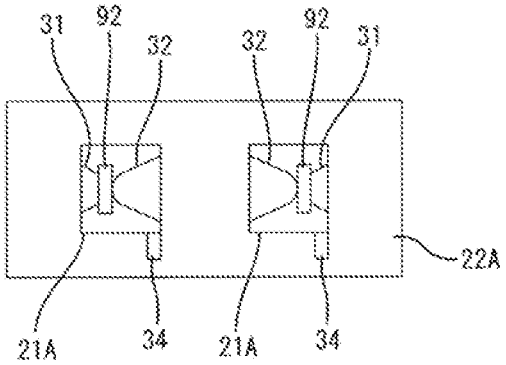
FIG. 9 is a diagram of a mode shown in FIGS. 1 to 8.

The resilient contact piece 32 projects farther into the box 27 than the receiving portion 31. When the UTP connection terminal 21A is connected to the male terminal 91, a later-described tab 92 of the male terminal 91 is inserted into the box 27 and the inserted tab 92 is resiliently sandwiched between the receiving portion 31 and the resilient contact piece 32, as schematically shown in FIG. 9. Further, the UTP connection terminal 21A includes a protrusion 34 projecting out (in a direction along a plane direction of the ceiling plate 33; down in a state accommodated in the accommodating portion 26) from one end of the ceiling plate 33.

UTP Dielectric

Figure 4:
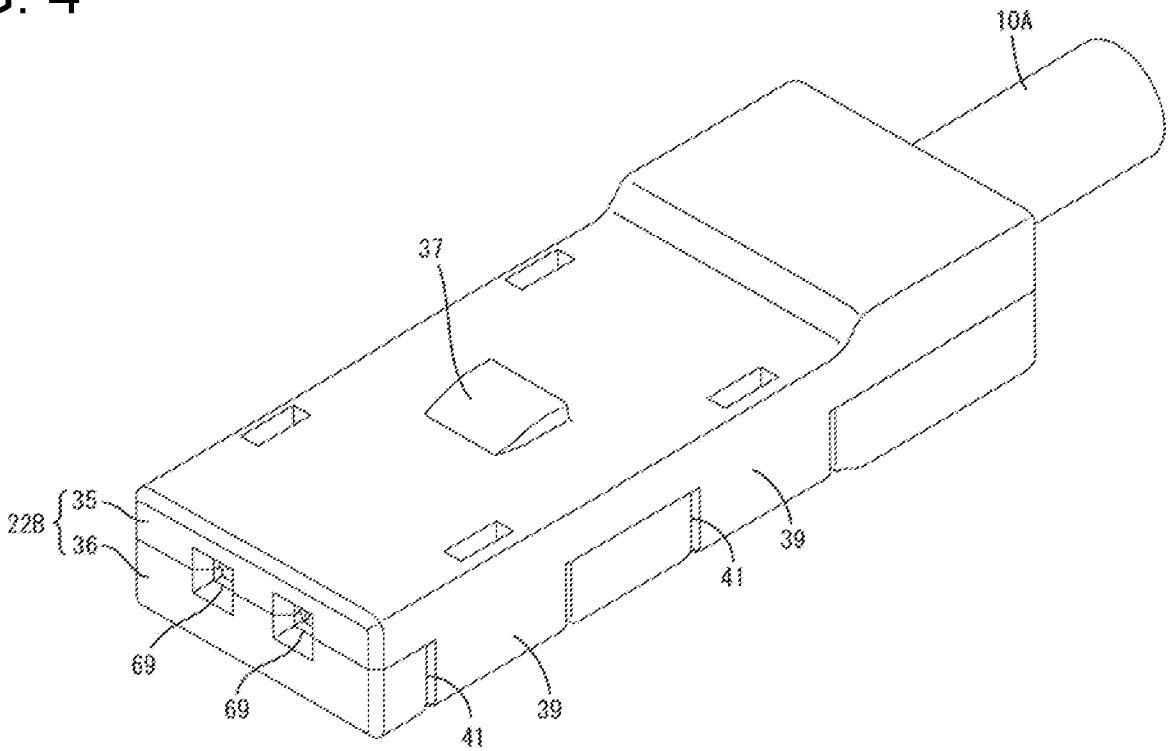
FIG. 4 is a perspective view showing a state where the UTP connection terminals are covered by an upper dielectric of the UTP dielectric.

The UTP dielectric 22A is made of synthetic resin and, as shown in FIGS. 1 and 4, is composed of an upper dielectric 35 and a lower dielectric 36 that are vertically dividable. The upper dielectric 35 is a plate substantially rectangular in a plan view and includes a lock projection 37 in a widthwise central part of an upper surface. The lock projection 37 is lockable to the UTP housing 23A. Recesses 38 (see FIG. 6 and FIG. 12 although the STP dielectric 22B is shown) are provided in the lower surface of the upper dielectric 35 for positioning upper parts of the respective UTP connection terminals 21A in parallel and positioning an upper part of the crimp ring 29. Front and rear mounting pieces 39 project down on each widthwise end of the upper dielectric 35.

The lower dielectric 36 is a plate substantially rectangular in a plan view and includes front and rear mounting receiving portions 41 in the form of rectangular recesses on both widthwise end parts and mounting projections 42 on the back surfaces of the mounting receiving portions 41. The mounting pieces 39 are fit into the respective mounting receiving portions 41 and tip parts of the mounting pieces 39 are hooked to lock the mounting projections 42. Thus, the lower dielectric 36 and the upper dielectric 35 are held united across the UTP connection terminals 21A.

The accommodating portions 26 for positioning and holding lower parts of the respective UTP connection terminals 21A in parallel are provided at positions facing the recesses 38 of the upper dielectric 35 in the upper surface of the lower dielectric 36. The accommodating portion 26 has a cross-sectional shape corresponding to the outer shape of the UTP connection terminal 21A, and two of the accommodating portions 26 are provided on both widthwise sides across a thin separation wall 43 to correspond to the respective UTP connection terminals 21A. Further, when the upper and lower dielectrics 35, 36 are united, tab insertion holes 69 that communicate with the accommodating portions 26 and the recesses 38 and into which the tabs 92 are inserted are open in the front surface of the UTP dielectric 22A.

The upper accommodating portion 26 in FIG. 8 includes a recess 44 (see FIG. 11 although the STP dielectric 22B is shown) having a rectangular cross-sectional shape at a position of a back bottom surface near the separation wall 43, and the other accommodating portion 26 includes a recess (likewise see FIG. 11) having a rectangular cross-sectional shape at a position of a back bottom surface near a widthwise outer side wall located on a side opposite to the separation wall 43. Steps 52 are provided on the separation wall 43 and the widthwise outer side wall at positions adjacent to the recesses 44 and receive the rear ends of the ceiling plates 33 of the boxes 27 of the UTP connection terminals 21A. As shown in FIG. 8, the UTP connection terminal 21A accommodated in the one accommodating portion 26 is arranged such that the base plate 25 extends in the front-rear direction along a side surface of the widthwise outer wall (side surface of the widthwise outer side wall including no step 52), and the UTP connection terminal 21A accommodated in the other accommodating portion 26 is arranged such that the base plate 25 extends in the front-rear direction along the separation wall 43 (side surface of the separation wall 43 including no step 52). Further, a recess 46 is provided in the lower surface of the lower dielectric 36 and is continuous rearward from the accommodating portions 26 for positioning and holding a lower part of the crimp ring 29.

UTP Housing

Figure 6:
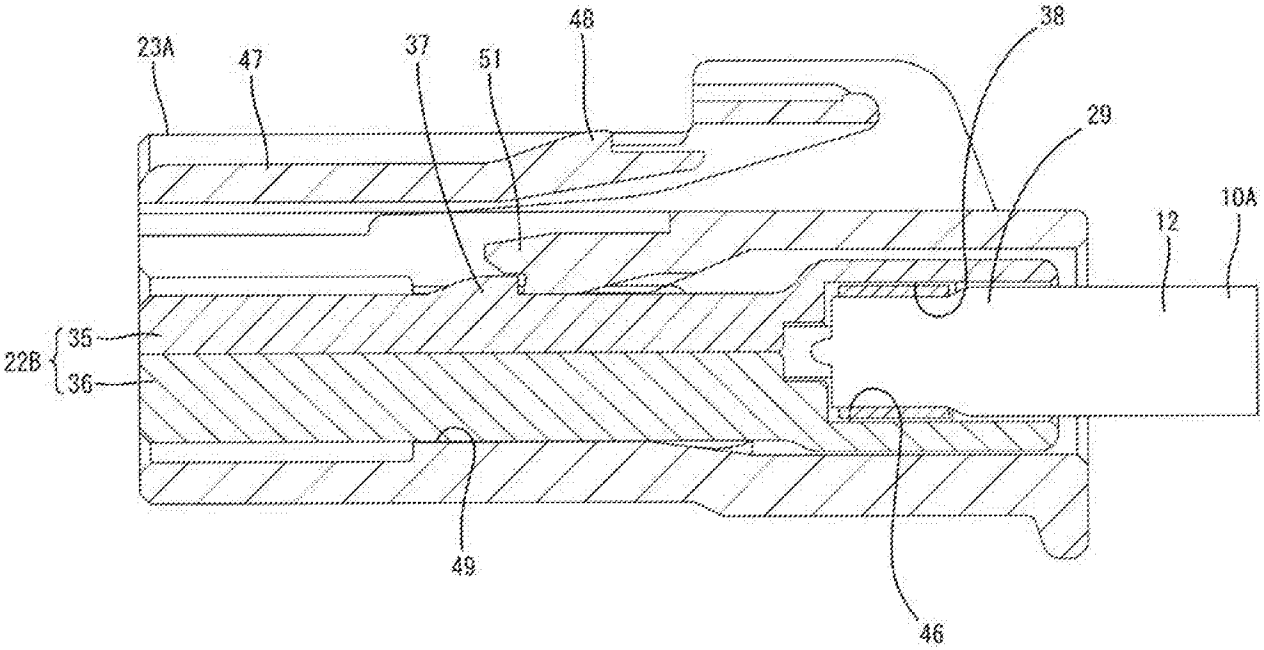
FIG. 6 is a section showing a locking structure of the UTP dielectric accommodated in the UTP housing.

The UTP housing 23A is made of synthetic resin and includes, as shown in FIG. 5, a substantially rectangular tubular housing body 47. A lock arm 48 projects in a widthwise central part of the upper surface of the housing body 47. The lock arm 48 is cantilevered rearward from a front part of the upper surface of the housing body 47, and holds the UTP connector 20A and the mating UTP connector 90A in a connected state by resiliently locking a lock receiving portion 93 of the mating UTP connector 90A. The inside of the housing body 47 is open in the front-rear direction to define an insertion portion 49. The insertion portion 49 has a cross-sectional shape corresponding to the outer shape of the UTP dielectric 22A, and the UTP dielectric 22A can fit therein. As shown in FIG. 6, a deflectable and deformable locking lance 51 is cantilevered forward on the upper surface of the inner wall of the insertion portion 49. The UTP dielectric 22A is inserted into the insertion portion 49 from behind, and the locking lance 51 returns to lock the lock projection 37 after being deflected and deformed by the lock projection 37. Thus, the UTP dielectric 22A is held in the UTP housing 23A.

Mating UTP Connector

Figure 7:
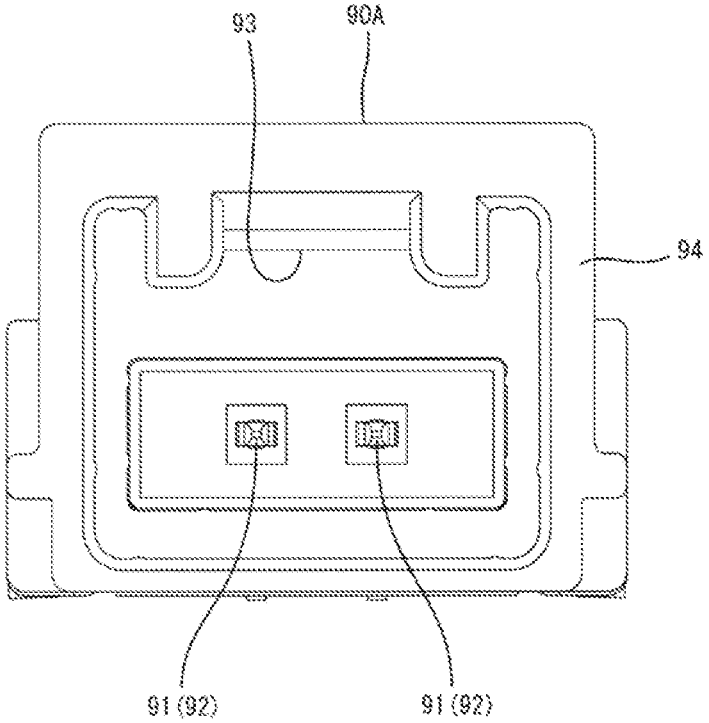
FIG. 7 is a front view of a mating UTP connector.

The mating UTP connector 90A includes a receptacle 94 made of synthetic resin. The receptacle 94 is supported on an unillustrated circuit board and the UTP housing 23A can fit therein. As shown in FIG. 7, the lock receiving portion 93 to be locked by the lock arm 48 projects on the inner surface of the upper wall of the receptacle 94.

As shown in FIG. 8, pegs 95 made of a metal plate material are mounted on the outer surfaces of both side walls of the receptacle 94. By soldering the pegs 95 to a surface of the circuit board, the mating UTP connector 90A is fixed to the circuit board via the pegs 95.

The male terminals 91 paired in the width direction are mounted in the receptacle 94. Each male terminal 91 is in the form of a rectangular wire (rectangular pin) and includes a bent part at an intermediate position in a length direction. Each male terminal 91 includes the tab 92 projecting into the receptacle 94. The tabs 92 of the respective male terminals 91 have a flat cross-sectional shape in the width direction and are arranged in parallel while having a separation distance in the width direction corresponding to that between the respective UTP connection terminals 21A. Further, each male terminal 91 includes a part projecting outward, and this part is mounted on, soldered and connected to the surface of the unillustrated circuit board.

STP Cable

The STP cable 10B is composed of a pair of twisted wires 11, a shield conductor 13, such as a braided wire for surrounding and shielding the respective wires 11, and a sheath 12 surrounding the shield conductor 13. An end part of each wire 11 and an end part of the shield conductor 13 are exposed from the sheath 12. The end part of the shield conductor 13 is folded and put on an outer peripheral side of the sheath 12. The end part of each wire 11 is connected to the STP connection terminal 21B.

STP Connection Terminal

The STP connection terminals 21B to be connected to the respective wires 11 of the STP cable 10B have the same shape. As shown in FIG. 23, the STP connection terminal 21B is connected to a male terminal 91 provided in the mating STP connector 90B when the STP connector 20B and the mating STP connector 90B are connected. The STP connection terminal 21B is formed integrally such as by bending a conductive metal plate material and is shaped to be long and narrow in the front-rear direction.

This STP connection terminal 21B has substantially the same configuration as the UTP connection terminal 21A and includes a base plate 25, a box 27 and a barrel 28. The box 27 and the barrel 28 of the STP connection terminal 21B have substantially the same shapes as the box 27 and the barrel 28 of the UTP connection terminal 21A.

As shown in FIG. 23, a resilient contact piece 32 is provided on the base plate 25 and a receiving portion 31 is provided on a ceiling plate 33 in the STP connection terminal 21B to be accommodated into one accommodating portion 26 to be described later. In contrast, in the STP connection terminal 21B to be accommodated into the other accommodating portion 26 to be described later, a receiving portion 31 is provided on the base plate 25 and a resilient contact piece 32 is provided on a ceiling plate 33. As just described, a positional relationship of the resilient contact piece 32 and the receiving portion 31 is reversed between the STP connection terminal 21B and the UTP connection terminal 21A. The shapes of the respective resilient contact piece 32 and receiving portion 31 are the same as in the case of the UTP connection terminal 21A. Further, the STP connection terminal 21B includes a protrusion 34 projecting out from one end side of the ceiling plate 33 as in the UTP connection terminal 21A.

STP Dielectric

Figure 16:
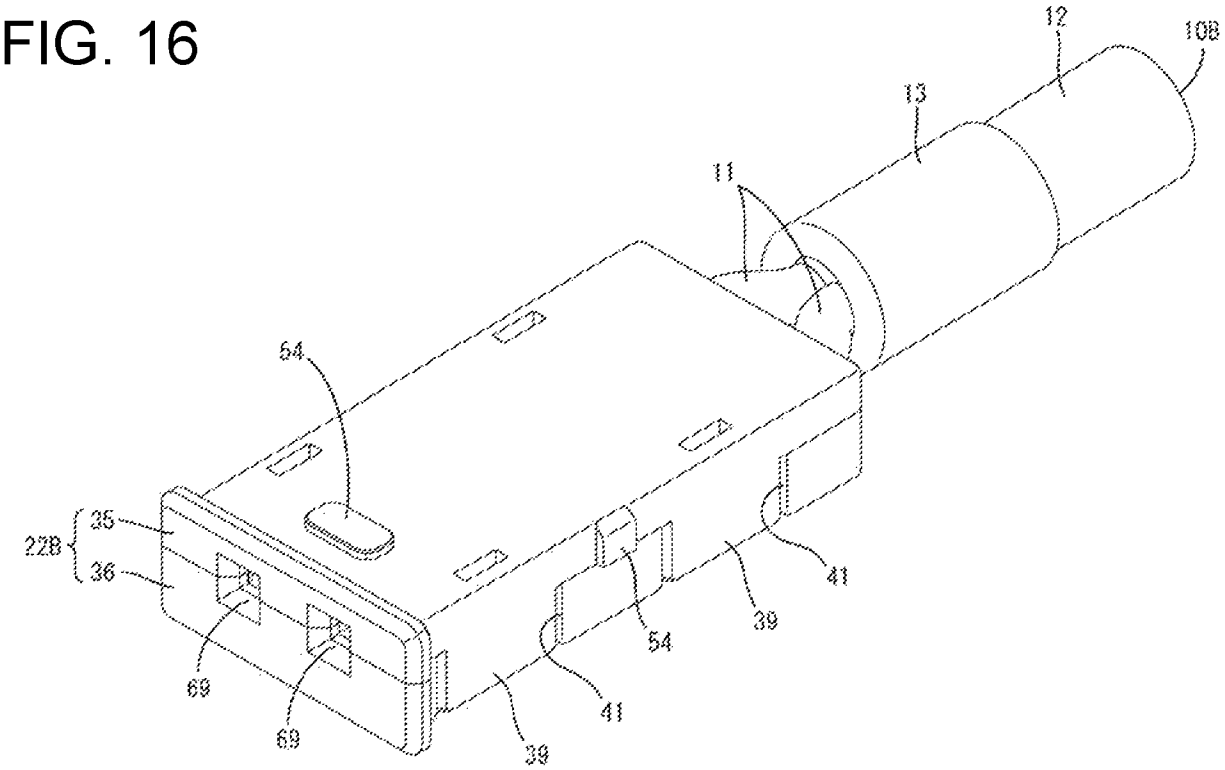
FIG. 16 is a perspective view showing a state where the STP connection terminals are covered by the upper dielectric of the STP dielectric.

The STP dielectric 22B is made of synthetic resin and, as shown in FIGS. 10 and 16, is composed of an upper dielectric 35 and a lower dielectric 36 that are vertically dividable. The upper dielectric 35 is a plate substantially rectangular in a plan view and includes positioning protrusions 54 for the outer conductor 24B on an upper surface and both side surfaces. Similar to the upper dielectric 35 of the UTP dielectric 22A, mounting pieces 39 are provided on both widthwise end parts of the upper dielectric 35. The lower dielectric 36 also is provided with mounting receiving portions 41 and mounting projections 42 similar to the lower dielectric 36 of the UTP dielectric 22A, and the lower and upper dielectrics 36, 35 are held united across the STP connection terminals 21B by the locking of the mounting pieces 39 and the mounting projections 42.

The STP connector 20B has no crimp ring 29 and a part (part corresponding to the recess 46) for receiving the crimp ring 29 is not necessary in rear parts of the upper and lower dielectrics 35, 36. Thus, dimensions of the upper and lower dielectrics 35, 36 in the front-rear direction are shorter than that of the UTP dielectric 22A by that much.

Figure 11:
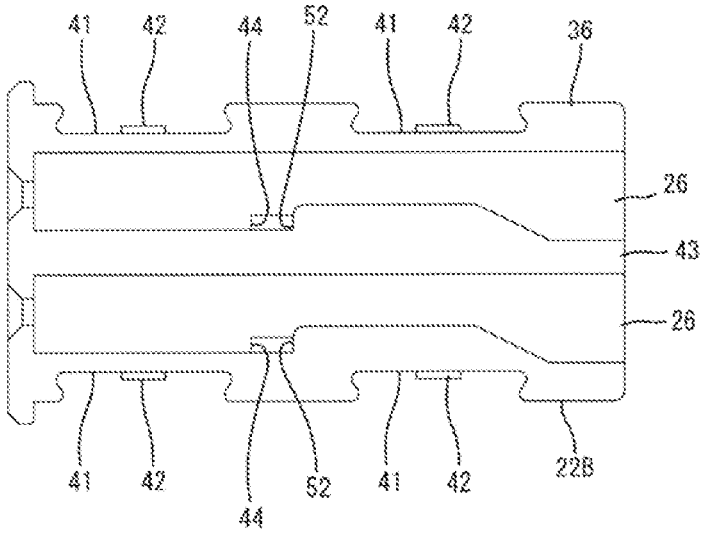
FIG. 11 is a plan view of a lower dielectric of an STP dielectric.
Figure 12:
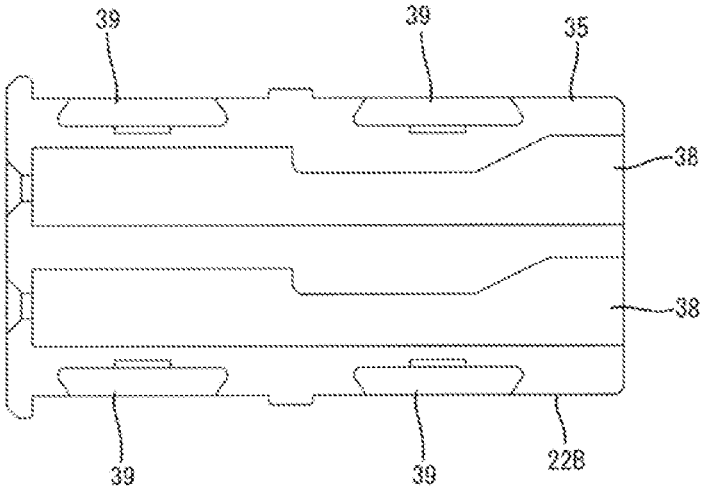
FIG. 12 is a bottom view of an upper dielectric of the STP dielectric.

Recesses 38 for positioning upper parts of the respective STP connection terminals 21B in parallel are provided in the lower surface of the upper dielectric 35, as shown in FIG. 12. Additionally, accommodating portions 26 for positioning and holding the lower parts of the respective STP connection terminals 21B in parallel are provided at positions facing the recesses 38 in the upper surface of the lower dielectric 36, as shown in FIG. 11.

The accommodating portion 26 has a cross-sectional shape corresponding to the outer shape of the STP connection terminal 21B, and a pair of the accommodating portions 26 are provided on both widthwise sides across a separation wall 43 to correspond to the respective STP connection terminals 21B. A thickness (dimension in the width direction) of the separation wall 43 of the STP dielectric 22B is larger than that of the separation wall 43 of the UTP dielectric 22A. That is, a separation distance in the width direction (hereinafter, referred to as a pitch width) of the respective accommodating portions 26 of the STP dielectric 22B is larger than that of the respective accommodating portions 26 of the UTP dielectric 22A. Further, when the upper and lower dielectrics 35, 36 are united, tab insertion holes 69 are defined in the front surface of the STP dielectric 22B. The tab insertion holes 69 communicate with the accommodating portions 26 and the recesses 38 and receive the tabs 92.

The upper accommodating portion 26 in FIG. 11 includes a recess 44 having a rectangular cross-sectional shape at a position of a back bottom surface near the separation wall 43, and the other accommodating portion 26 includes a recess 44 similarly having a rectangular cross-sectional shape at a position of a back bottom surface near a widthwise outer side wall (widthwise outer side wall located on a side opposite to the separation wall 43). Steps 52 are provided on the separation wall 43 and the widthwise outer side wall at positions that are adjacent to the recesses 44. The rear ends of the ceiling plates 33 of the boxes 27 of the STP connection terminals 21B are fit into the steps 52. As shown in FIG. 23, the STP connection terminal 21B accommodated in the one accommodating portion 26 is arranged such that the base plate 25 extends in the front-rear direction along a side surface of the widthwise outer side wall (side surface of the widthwise outer side wall including no step portion 52), and the STP connection terminal 21B accommodated in the other accommodating portion 26 is arranged such that the base plate 25 extends in the front-rear direction along the separation wall 43 (side surface of the separation wall 43 including no step portion 52). The form of each accommodating portion 26 is the same as in the case of the UTP connection terminals 21A.

Outer Conductor

Figure 14:
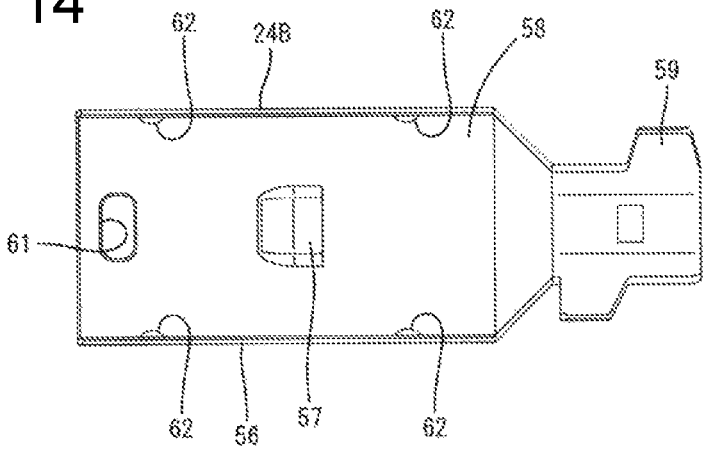
FIG. 14 is a bottom view of an upper outer conductor.
Figure 18:
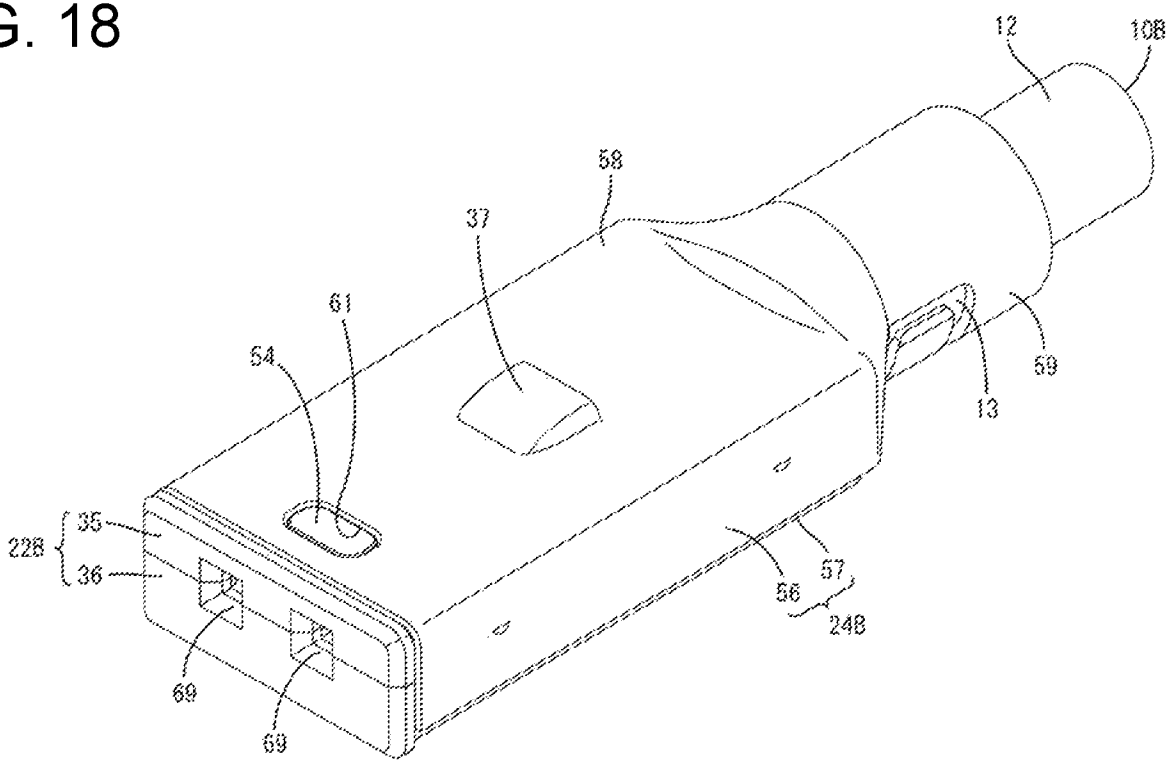
FIG. 18 is a perspective view showing a state where the upper outer conductor covers an upper part of the STP dielectric.

The outer conductor 24B is made of conductive metal and, as shown in FIGS. 10 and 18, is composed of an upper outer conductor 56 and a lower outer conductor 57 that are vertically dividable. As shown in FIG. 14, the upper outer conductor 56 includes an upper shell 58 that is substantially rectangular in a plan view and an open upper barrel 59 that is connected to and behind the upper shell 58. The upper shell 58 is arranged to cover the upper dielectric 35 from above. A flat plate of the upper shell 58 includes a lock projection 37 in a widthwise central part of an upper surface and an upper positioning hole 61 in front of the lock projection 37. Further, the upper shell 58 includes side plates hanging down from both widthwise ends of the flat plate, and front and rear holding projections 62 on the inner surface of each of the side plates. The upper barrel 59 includes a projecting piece displaced in the front-rear direction from both widthwise sides and projecting down.

Figure 13:
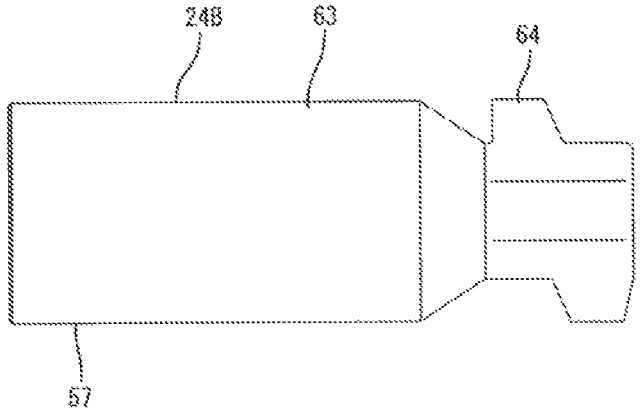
FIG. 13 is a bottom view of a lower outer conductor.
Figure 17:
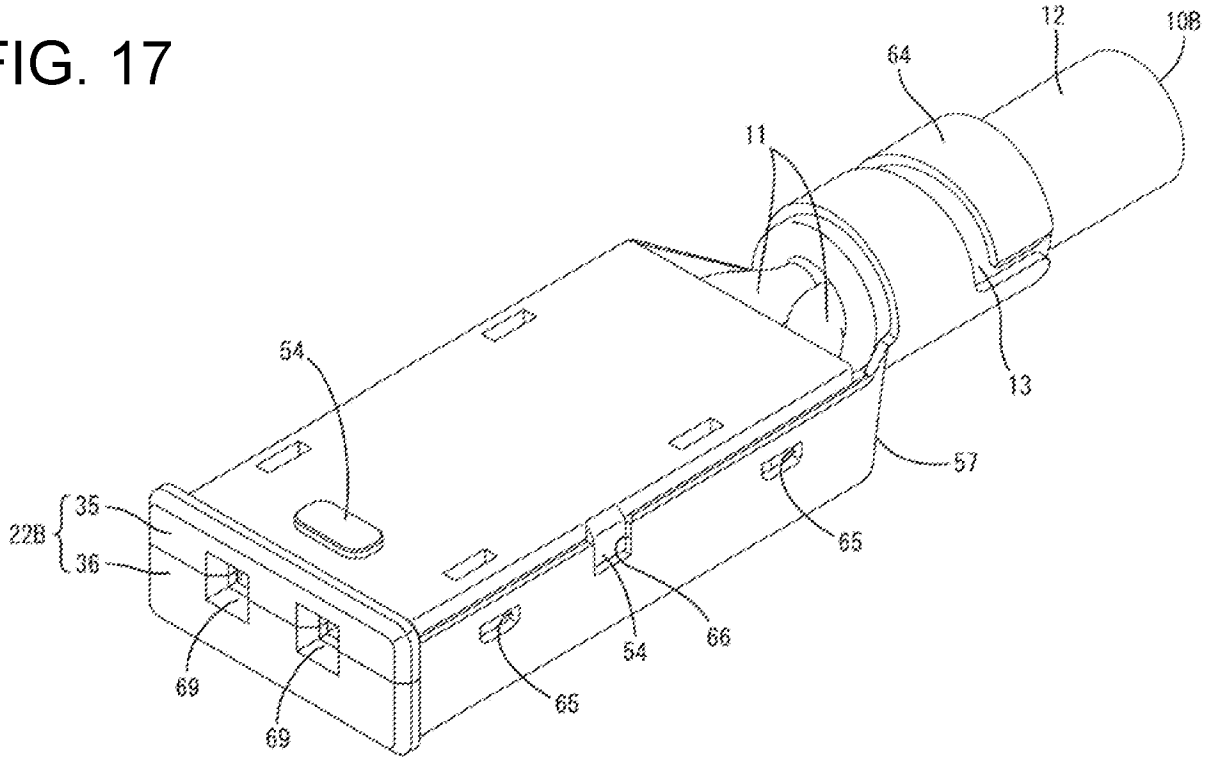
FIG. 17 is a perspective view showing a state where the lower outer conductor covers a lower part of the STP dielectric.

As shown in FIG. 13, the lower outer conductor 57 includes a lower shell 63 that is substantially rectangular in a plan view and an open lower barrel 64 that is connected to and behind the lower shell 63. As shown in FIG. 17, the lower shell 63 is arranged to cover the lower dielectric 36 from below. The lower shell 63 includes side plates rising from both widthwise ends of a flat plate and front and rear holding holes 65 in each of the side plates. Further, lower positioning holes 66 are open in the upper ends of central parts of the side plates of the lower shell 63 in the front-rear direction. The lower barrel 64 includes a projecting piece displaced in the front-rear direction from both widthwise ends and projecting up.

Figure 20:
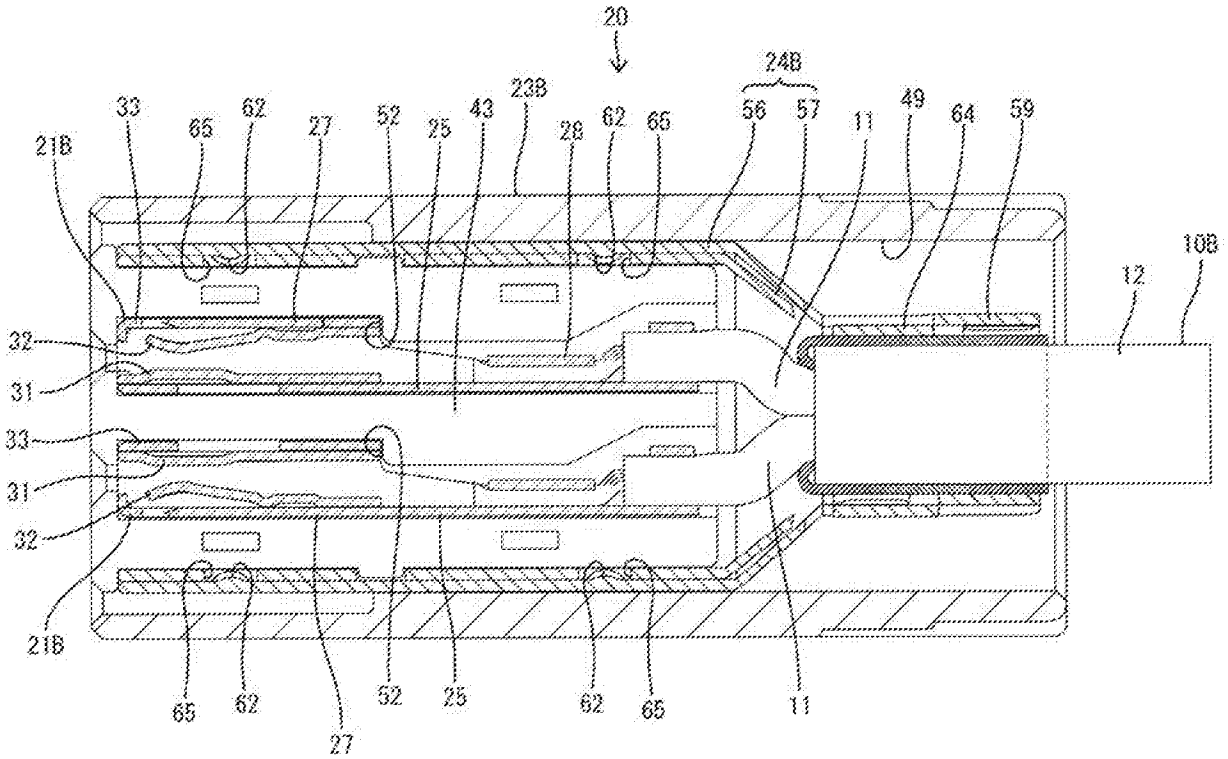
FIG. 20 is a section of the STP dielectric, the STP connection terminals and an outer conductor accommodated in the STP housing.

When the upper and lower outer conductors 56, 57 are united while enclosing the STP dielectric 22B, the side plates of the upper shell 58 cover those of the lower shell 63 from outside and, as shown in FIG. 20, the respective holding projections 62 are inserted and locked into the holding holes 65. Further, front and rear projecting pieces of each of the upper and lower barrels 59, 64 are arranged alternately.

STP Housing

Figure 21:
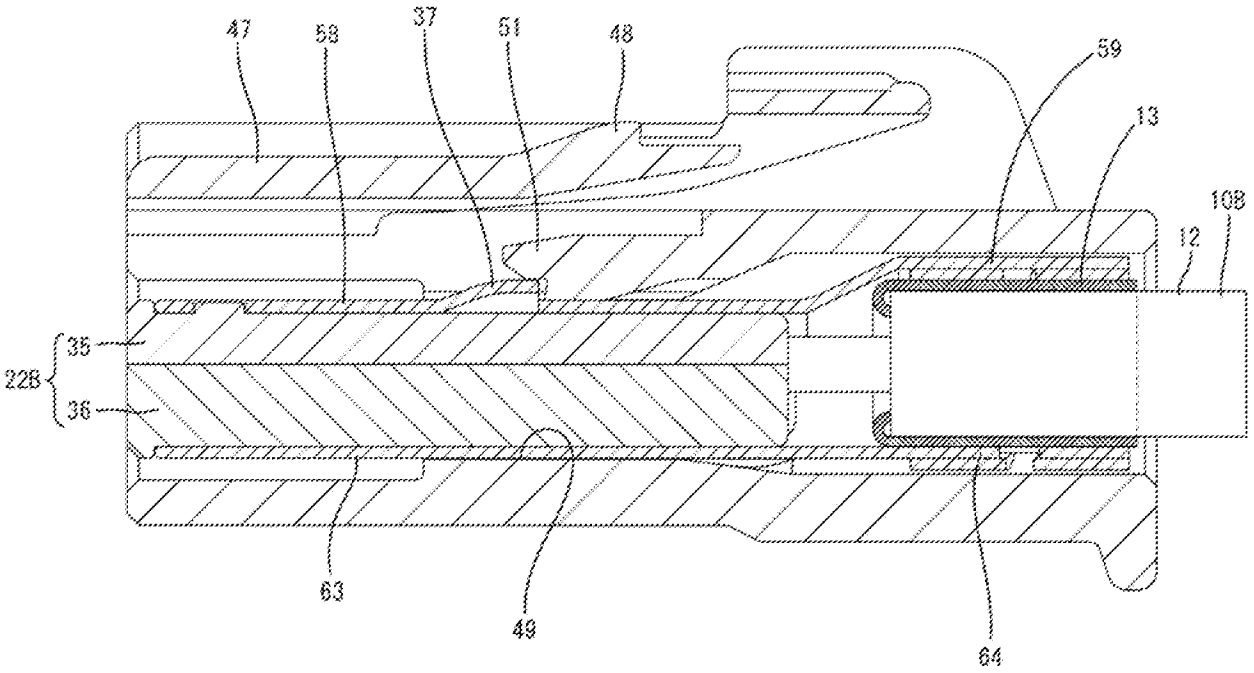
FIG. 21 is a section showing a locking structure of the outer conductor accommodated in the STP housing.
Figure 22:
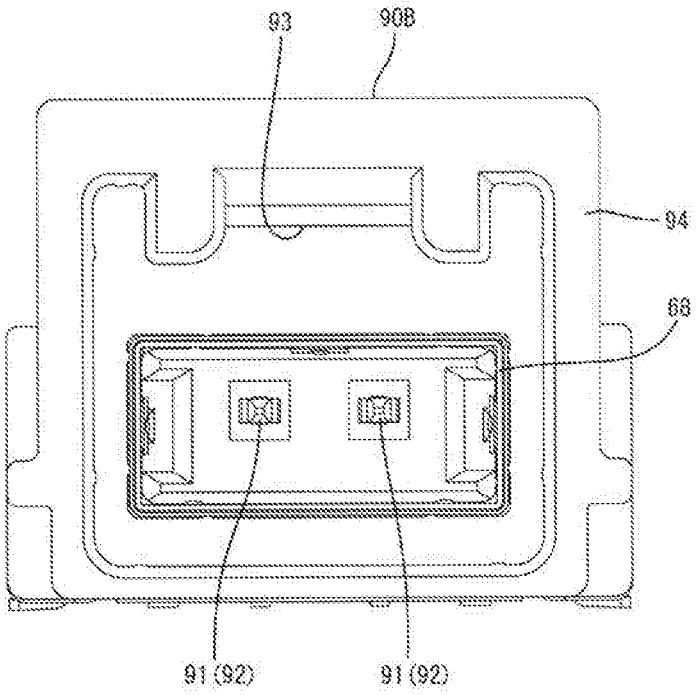
FIG. 22 is a front view of a mating STP connector.

The STP housing 23B is made of synthetic resin and includes a substantially rectangular tubular housing body 47. The STP housing 23B has substantially the same shape as the UTP housing 23A and includes a lock arm 48, an insertion portion 49 and a locking lance 51 having the same forms (shapes and arrangement) of those of the UTP housing 23A. Of course, as shown in FIG. 21, a locking partner of the locking lance 51 is not the STP dielectric 22B, but the upper outer conductor 56.

Mating STP Connector

The mating STP connector 90B includes a receptacle 94 made of synthetic resin. The mating STP connector 90B has substantially the same configuration as the mating UTP connector 90A and includes the receptacle 94, a lock receiving portion 93, pegs 95 and a pair of male terminals 91. A pitch width of the respective male terminals 91 of the mating STP connector 90B is wider than that of the male terminals 91 of the mating UTP connector 90A.

Assembling of UTP Connector

Figure 3:
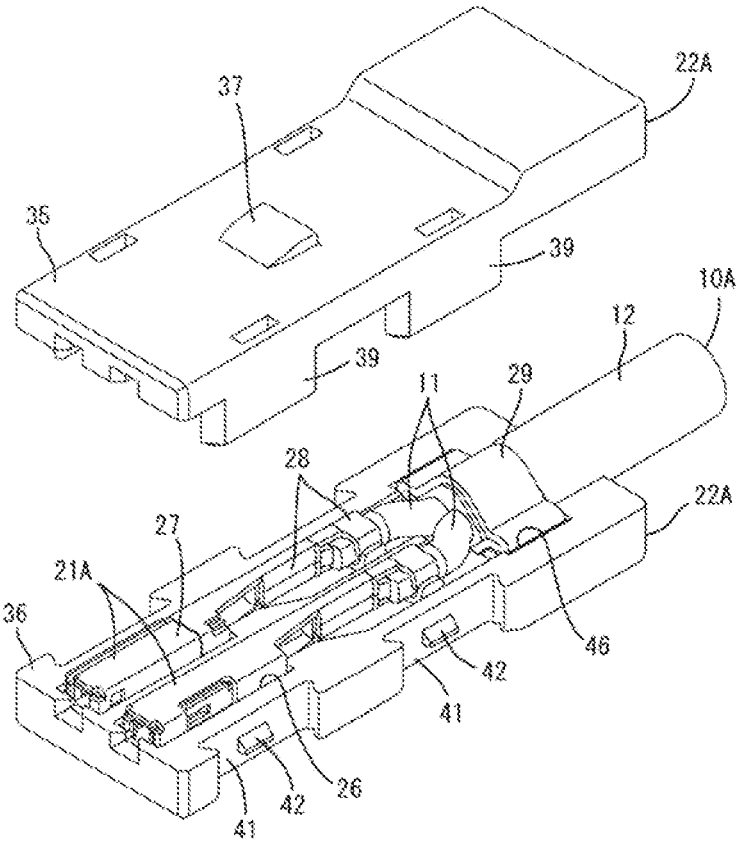
FIG. 3 is a perspective view showing a state where the UTP connection terminals are accommodated in accommodating portions of a UTP dielectric.

In assembling the UTP connector 20A, the barrels 28 of the UTP connection terminals 21A are first connected to the end parts of the respective wires 11 of the UTP cable 10A by crimping, as shown in FIG. 2. Subsequently, as shown in FIG. 3, the respective UTP connection terminals 21A are positioned and inserted into the accommodating portions 26 of the lower dielectric 36 from above, and the crimp ring 29 fit to the UTP cable 10A is positioned and inserted into the recessed portion 46 of the lower dielectric 36. At this time, the respective UTP connection terminals 21A are inserted with the protrusions 34 arranged to face down in the same direction. Subsequently, as shown in FIG. 4, the upper dielectric 35 is put on the lower dielectric 36 from above. The mounting pieces 39 resiliently lock the mounting projections 42 to hold the upper and lower dielectrics 35, 36 (UTP dielectric 22A) united. The respective UTP connection terminals 21A are arranged in parallel to each other in the UTP dielectric 22A with the base plates 25 thereof located on one widthwise side (upper side in FIG. 8).

Subsequently, the UTP dielectric 22A is inserted into the insertion portion 49 of the UTP housing 23A from behind. When the UTP dielectric 22A is inserted properly into the insertion portion 49, as shown in FIG. 6, the locking lance 51 resiliently locks the lock projection 37 of the UTP dielectric 22A to hold the UTP dielectric 22A in the UTP housing 23A.

Assembling of STP Connector

Figure 15:
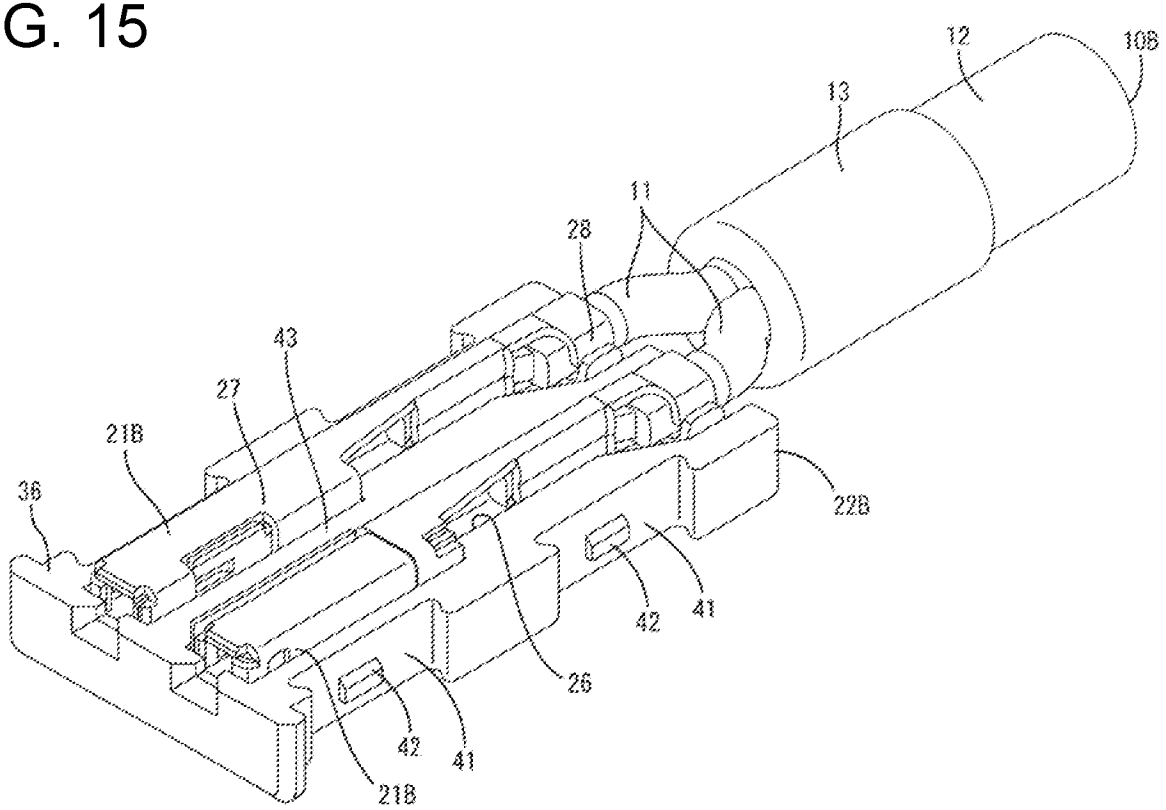
FIG. 15 is a perspective view showing a state where STP connection terminals are accommodated in accommodating portions of the STP dielectric.

Also in assembling the STP connector 20B, the barrels 28 of the STP connection terminals 21B first are connected to the end parts of the respective wires 11 of the STP cable 10B by crimping. Subsequently, as shown in FIG. 15, the respective STP connection terminals 21B are inserted into the accommodating portions 26 of the lower dielectric 36 from above. At this time, the respective STP connection terminals 21B are inserted into the accommodating portions 26 with the protrusions 34 arranged to face down in the same direction. Then, as shown in FIG. 16, the upper dielectric 35 is put on the lower dielectric 36 from above and the upper and lower dielectrics 35, 36 are held united by the locking of the mounting pieces 39 and the mounting projections 42. The respective STP connection terminals 21B are arranged in parallel to each other in the STP dielectric 22B with the base plates 25 held on one widthwise side (upper side in FIG. 23). A pitch width of the respective STP connection terminals 21B in the STP dielectric 22B is larger than that of the respective UTP connection terminals 21A in the UTP dielectric 22A due to the thicker separation wall 43.

Subsequently, as shown in FIG. 17, the STP dielectric 22B is placed on the lower shell 63 of the lower outer conductor 57. The positioning protrusions 54 disposed on the both side surfaces of the upper dielectric 35 are aligned with and fit into the lower positioning holes 66 of the lower shell 63 to position the lower outer conductor 57 with respect to the STP dielectric 22B in the front-rear direction. At this time, the lower barrel 64 faces the shield conductor 13 exposed on the outer peripheral side of the STP cable 10B from below. In that state, the lower barrel 64 is connected to the shield conductor 13 of the STP cable 10B by crimping.

Subsequently, as shown in FIG. 18, the upper outer conductor 56 is put on the lower outer conductor 57 to cover the STP dielectric 22B from above. The upper and lower outer conductors 56, 57 (outer conductor 24B) are held in a division restricted state by the locking of the holding projections 62 and the holding holes 65. Further, the positioning protrusion 54 disposed on the upper surface of the upper dielectric 35 is aligned with and fit into the upper positioning hole 61 of the upper shell 58 to position the upper outer conductor 56 with respect to the STP dielectric 22B in the front-rear direction. Then, the upper barrel 59 faces the shield conductor 13 of the STP cable 10B from above. In that state, the upper barrel 59 is connected to the shield conductor 13 of the STP cable 10B by crimping. In this way, the shield conductor 13 is connected to the outer conductor 24B and the STP connection terminals 21B are surrounded by the outer conductor 24B via the STP dielectric 22B.

Thereafter, the outer conductor 24B in the united state enclosing the respective STP connection terminals 21B and the STP dielectric 22B is inserted into the insertion portion 49 of the STP housing 23B from behind. When the outer conductor 24B is inserted properly into the insertion portion 49, as shown in FIG. 21, the locking lance 51 resiliently locks the lock projection 37 of the outer conductor 24B and the outer conductor 24B is retained and held in the STP housing 23B.

Connector Connection

When the UTP connector 20A is connected properly to the mating UTP connector 90A, the lock arm 48 resiliently locks the lock receiving portion 93 and the connectors 20A, 90A are held in a separation restricted state. At this time, as shown in FIG. 8, the tabs 92 of the respective male terminals 91 are inserted and connected into the boxes 27 of the respective UTP connection terminals 21A.

Similarly, when the STP connector 20B is connected properly to the mating STP connector 90B, the lock arm 48 resiliently locks the lock receiving portion 93, the connectors 20B, 90B are held in a separation restricted state and, as shown in FIG. 23, the tabs 92 of the respective male terminals 91 are inserted and connected into the boxes 27 of the respective STP connection terminals 21B. Further, the outer conductor 24B is connected to a ground plate 68 disposed in the receptacle 94.

Functions and Effects

Figure 24:
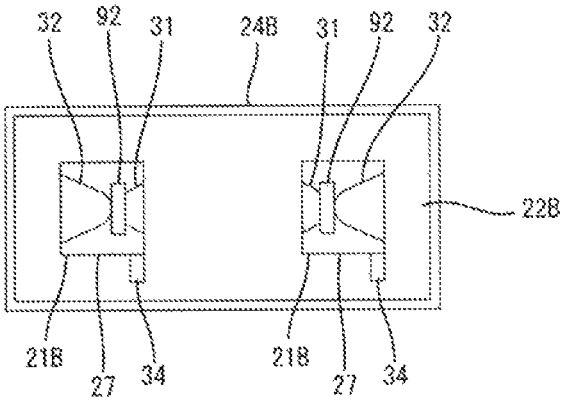
FIG. 24 is a diagram of a mode shown in FIGS. 10 to 23.

As described above, the pitch width of the respective UTP connection terminals 21A accommodated in the accommodating portions 26 of the UTP dielectric 22A is smaller than that of the respective STP connection terminals 21B accommodated in the accommodating portions 26 of the STP dielectric 22B (see FIGS. 9 and 24). Thus, impedance on the side of the UTP cable 10A is reduced and impedance on the side of the STP cable 10B is increased. Thus, compatibility between the UTP connector 20A and the STP connector 20B can be realized while the impedance is adjusted.

The UTP connector 20A and the STP connector 20B have a substantially common configuration and there is no large structural difference between the configurations thereof except that the STP connector 20B includes the outer conductor 24B. Further, the mating UTP connector 90A and the mating STP connector 90B also have substantially the same structure. Thus, in replacing the UTP cable 10A by the STP cable 10B or replacing the STP cable 10B by the UTP cable 10A, the connector structure need not be changed significantly and cost can be reduced.

Further, the respective UTP connection terminals 21A and the respective STP connection terminals 21B all are accommodated into the corresponding accommodating portions 26 with the protrusions 34 facing downward, and mounted in the same direction. Thus, mistakes in a mounting operation can be avoided and work efficiency can be improved.

Furthermore, the respective UTP connection terminals 21A are arranged in the accommodating portions 26 paired in the width direction such that the resilient contact pieces 32 are located on widthwise inner sides and the receiving portions 31 are located on widthwise outer sides (see FIG. 9), and the respective STP connection terminals 21B are arranged in the accommodating portions 26 paired in the width direction such that the resilient contact pieces 32 are located on widthwise outer sides and the receiving portions 31 are located on widthwise inner sides (see FIG. 24). Thus, the pitch width of the respective male terminals 91 can be substantially the same between the mating UTP connector 90A and the mating STP connector 90B. Further, in adjusting the impedance, it is sufficient only to reverse the positional relationship of the resilient contact pieces 32 and the receiving portions 31 between the UTP connector 20A and the STP connector 20B and it is not necessary to apply special processing, wherefore cost can be further reduced.

Other embodiments are briefly described.

Although both the UTP dielectric and the STP dielectric are vertically dividable in the above embodiment, at least one of the UTP dielectric and the STP dielectric may be unitarily formed to be undividable according to the present invention.

Although the outer conductor of the STP connector is vertically dividable in the above embodiment, the outer conductor may be formed unitarily to be undividable according to the present invention.

The box may be provided with two or more protrusions projecting in the same direction.

LIST OF REFERENCE SIGNS

10A . . . UTP cable
10B . . . STP cable
11 . . . wire
20A . . . UTP connector
20B . . . STP connector
21A . . . UTP connection terminal
21B . . . STP connection terminal
22A . . . UTP dielectric
22B . . . STP dielectric
26 . . . accommodating portion
27 . . . box
31 . . . receiving portion
32 . . . resilient contact piece
34 . . . protrusion
90A . . . mating UTP connector
90B . . . mating STP connector
91 . . . male terminal

The invention claimed is:

1. A connector system, comprising:

UTP connection terminals each including a box portion and a protrusion, a male terminal being inserted and connected into the box portion, the protrusion projecting outwardly of the box portion, the UTP connection terminals being connected to respective wires of a UTP cable;

STP connection terminals each including a box portion and a protrusion, a male terminal being inserted and connected into the box portion, the protrusion projecting outwardly of the box portion, the STP connection terminals being connected to respective wires of a STP cable;

a UTP dielectric including accommodating portions for accommodating the UTP connection terminals; and an STP dielectric including accommodating portions for accommodating the STP connection terminals;

a pair of the accommodating portions of the UTP dielectric and a pair of the accommodating portions of the STP dielectric being arranged in a width direction perpendicular to an inserting direction of the male terminals;

the UTP connection terminals being arranged close to each other in the width direction by being accommodated into the pair of accommodating portions of the UTP dielectric proximate in the width direction;

the STP connection terminals being arranged more away from each other in the width direction than in the case of the UTP connection terminals by being accommodated into the pair of accommodating portions of the STP dielectric spaced apart in the width direction;

the UTP connection terminals and the STP connection terminals being set such that all the protrusions are in the same orientation in a state accommodated in the accommodating portions;

a UTP housing accommodating the UTP dielectric with the UTP connection terminals accommodated therein; and an STP housing accommodating the STP dielectric with the STP connection terminals accommodated therein, wherein the UTP housing and the STP housing have substantially the same shape thereby facilitating changes between UTP cables and STP cables;

each of the UTP connection terminals and the STP connection terminals has a receiving portion and a resilient contact piece facing the receiving portion and arranged in the box portion, the resilient contact piece projects more into the box portion than the receiving portion and the male terminal is sandwiched between the receiving portion and the resilient contact piece;

the UTP connection terminals are accommodated in the pair of accommodating portions of the UTP dielectric such that the resilient contact pieces are located on inner sides proximate in the width direction and the receiving portions are located on outer sides spaced apart in the width direction; and the STP connection terminals are accommodated in the pair of accommodating portions of the STP dielectric such that the resilient contact pieces are located on outer sides spaced apart in the width direction and the receiving portions are located on inner sides proximate in the width direction.

2. The connector system of claim 1, wherein the UTP connection terminals are disposed in the UTP dielectric to receive mating terminals spaced apart by a specified pitch, and the STP connection terminals are disposed in the STP dielectric to receive mating terminals spaced apart by the specified pitch.

* * * * *